US008982004B1

(12) United States Patent
Santoru et al.

(10) Patent No.: US 8,982,004 B1
(45) Date of Patent: Mar. 17, 2015

(54) INTEGRATED ODU CONTROLLER FOR ANTENNA POINTING

(75) Inventors: Joseph Santoru, Agoura Hills, CA (US); John L. Norin, Redondo Beach, CA (US); Dipak M. Shah, Westminster, CA (US); Gustave R. Stroes, Beverly Hills, CA (US); David J. Kuether, Brea, CA (US); Shamik Maitra, Marina Del Rey, CA (US); Benjamin Mui, Redondo Beach, CA (US); Ernest C. Chen, San Pedro, CA (US)

(73) Assignee: The DIRECTV Group, Inc., El Segunda, CA (US)

( * ) Notice: Subject to any disclaimer, the term of this patent is extended or adjusted under 35 U.S.C. 154(b) by 1564 days.

(21) Appl. No.: 12/185,018

(22) Filed: Aug. 1, 2008

Related U.S. Application Data

(60) Provisional application No. 60/953,959, filed on Aug. 3, 2007.

(51) Int. Cl.
*H01Q 3/00* (2006.01)

(52) U.S. Cl.
USPC ..... 343/765; 343/757

(58) Field of Classification Search
USPC ..... 342/359; 343/760, 894, 757, 765
See application file for complete search history.

(56) References Cited

U.S. PATENT DOCUMENTS

| | | | | |
|---|---|---|---|---|
| 7,492,323 | B2 * | 2/2009 | Nielsen | 343/757 |
| 7,663,543 | B2 * | 2/2010 | Norin et al. | 342/359 |
| 2006/0077097 | A1 * | 4/2006 | Dybdal et al. | 342/359 |

OTHER PUBLICATIONS

Notice of Allowance dated Mar. 3, 2011 in U.S. Appl. No. 11/971,800, filed Jan. 9, 2008 by Gustave R. Stroes et al.
Notice of Allowance dated Jun. 16, 2011 in U.S. Appl. No. 11/971,808, filed Jan. 9, 2008 by Gustave R. Stroes et al.
Final Rejection dated Apr. 11, 2011 in U.S. Appl. No. 11/971,808, filed Jan. 9, 2008 by Gustave R. Stroes et al.

* cited by examiner

*Primary Examiner* — Dieu H Duong

(57) ABSTRACT

A method and system for aligning an antenna reflector with satellites in a satellite configuration. A method in accordance with the present invention comprises pointing the reflector to a position along an orbital arc used in the satellite configuration, commanding a Single Wire Multiswitch circuits which is coupled to the reflector of the antenna to output a signal from at least one satellite at the orbital slot, and adjusting the reflector to maximize reception of the signal from the orbital slot.

14 Claims, 6 Drawing Sheets

INTEGRATED ODU CONTROLLER FOR ANTENNA POINTING

CROSS-REFERENCE TO RELATED APPLICATIONS

This application claims the benefit under 35 U.S.C. §119 (e) of U.S. Provisional Application Ser. No. 60/953,959, filed on Aug. 3, 2007, by Joseph Santoru et al., entitled "INTEGRATED ODU CONTROLLER FOR ANTENNA POINTING,"

which application is incorporated by reference herein.

BACKGROUND OF THE INVENTION

1. Field of the Invention

The present invention relates generally to a satellite receiver system, and in particular, to an alignment method for multi-band consumer receiver antennas.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to eight IRDs on separate cables from a multiswitch.

FIG. 1 illustrates a typical satellite television installation of the related art.

System 100 shows an embodiment of a system using signals sent from Satellite A (SatA) 102, Satellite B (SatB) 104, and Satellite C (SatC) 106 (with transponders 28, 30, and 32 converted to transponders 8, 10, and 12, respectively) as well as other satellites using Ka-band signals that are typically located at the 99 and 103 orbital slots, that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location. Orbital locations are also known as "orbital slots" and are referred to as both "orbital locations" and "orbital slots" herein.

Satellite uplink signals 116 are transmitted by one or more uplink facilities 118 to the satellites 102-106 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

Each satellite 102-106 typically broadcasts downlink signals 120 in typically thirty-two (32) different sets of frequencies, often referred to as transponders, which are licensed to various users for broadcasting of programming, which can be audio, video, or data signals, or any combination. These signals have typically been located in the Ku-band Fixed Satellite Service (FSS) and Broadcast Satellite Service (BSS) bands of frequencies in the 10-13 GHz range and in the Ka-band FSS band of 18-21 GHz.

FIG. 2 illustrates a typical ODU of the related art.

In another embodiment, ODU 108 typically uses reflector dish 122 and feedhorn assembly 124 to receive and direct downlink signals 120 onto feedhorn assembly 124. Reflector dish 122 and feedhorn assembly 124 are typically mounted on bracket 126 and attached to a structure for stable mounting. Feedhorn assembly 124 typically comprises one or more Low Noise Block converters 128, which are connected via wires or coaxial cables to a multiswitch, which can be located within feedhorn assembly 124, elsewhere on the ODU 108, or within house 110. LNBs typically downconvert the FSS and/or BSS-band, Ku-band, and Ka-band downlink signals 120 into frequencies that are easily transmitted by wire or cable, which are typically in the L-band of frequencies, which typically ranges from 250 MHz to 2150 MHz. This downconversion makes it possible to distribute the signals within a home using standard coaxial cables.

The multiswitch enables system 100 to selectively switch the signals from SatA 102, SatB 104, and SatC 106, and deliver these signals via cables 124 to each of the IRDs 112A-D located within house 110. Typically, the multiswitch is a four-input, four-output (4×4) multiswitch, where two inputs to the multiswitch are from SatA 102, one input to the multiswitch is from SatB 104, and one input to the multiswitch is a combined input from SatB 104 and SatC 106. There can be other inputs for other purposes, e.g., off-air or other antenna inputs or for other LNBs receiving services from satellites at other orbital locations, without departing from the scope of the present invention. The multiswitch can be other sizes, such as a 6×8 multiswitch, if desired. SatB 104 typically delivers local programming to specified geographic areas, but can also deliver other programming as desired.

To maximize the available bandwidth in the Ku-band and Ka-band of downlink signals 120, each broadcast frequency is further divided into polarizations. Each LNB 128 can receive both orthogonal polarizations at the same time with parallel sets of electronics, so with the use of either an integrated or external multiswitch, downlink signals 120 can be selectively filtered out from travelling through the system 100 to each IRD 112A-D.

IRDs 112A-D currently typically use a one-way communications system to control the multiswitch. Each IRD 112A-D has a dedicated cable 124 connected directly to the multiswitch, and each IRD independently places a voltage and signal combination on the dedicated cable to program the multiswitch. For example, IRD 112A may wish to view a signal that is provided by SatA 102. To receive that signal, IRD 112A sends a voltage/tone signal on the dedicated cable back to the multiswitch, and the multiswitch delivers the satA 102 signal to IRD 112A on dedicated cable 124. IRD 112B independently controls the output port that IRD 112B is coupled to, and thus may deliver a different voltage/tone signal to the multiswitch. The voltage/tone signal typically comprises a 13 Volts DC (VDC) or 18 VDC signal, with or without a 22 kHz tone superimposed on the DC signal. 13 VDC without the 22 kHz tone would select one port, 13 VDC with the 22 kHz tone would select another port of the multiswitch, etc. There can also be a modulated tone, typically a 22 kHz tone, where the modulation schema can select one of any number of inputs based on the modulation scheme. For simplicity and cost savings, this control system has been used with the constraint of 4 cables coming for a single feedhorn assembly 124, which therefore only requires the 4 possible state combinations of tone/no-tone and hi/low voltage.

To reduce the cost of the ODU 108, outputs of the LNBs 128 present in the ODU 108 can be combined, or "stacked," depending on the ODU 108 design. The stacking of the LNB 128 outputs occurs after the LNB has received and downconverted the input signal. This allows for multiple polarizations, one from each satellite 102-106, to pass through each LNB 128. So one LNB 128 can, for example, receive the Left Hand Circular Polarization (LHCP) signals from SatC 102 and SatB 104, while another LNB receives the Right Hand Circular Polarization (RHCP) signals from SatB 104, which allows for fewer wires or cables between the feedhorn assembly 124 and the multiswitch.

The Ka-band of downlink signals 120 will be further divided into two bands, an upper band of frequencies called the "A" band and a lower band of frequencies called the "B" band. Once satellites are deployed within system 100 to broadcast these frequencies, the various LNBs 128 in the feedhorn assembly 124 can deliver the signals from the Ku-band, the A band Ka-band, and the B band Ka-band signals for a given polarization to the multiswitch. However, current IRD 112 and system 100 designs cannot tune across this entire resulting frequency band without the use of more than 4 cables, which limits the usefulness of this frequency combining feature.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data. However, as mentioned above, current IRDs 112 cannot use the information in some of the proposed frequencies used for downlink signals 120, thus rendering useless the information transmitted in those downlink signals 120. Typically, an antenna reflector 122 is pointed toward the southern sky, and roughly aligned with the satellite downlink 120 beam, and then fine-tuned using a power meter or other alignment tools. The precision of such an alignment is usually not critical. However, additional satellites have been deployed that require more exacting alignment methods, and, without exacting alignment of the antenna reflector 122, the signals from the additional satellites will not be properly received, rendering these signals useless for data and video transmission.

FIG. 2A illustrates another embodiment of an ODU of the related art.

Another embodiment of ODU 108 uses a Single Wire Multiswitch (SWM) ODU system 130. Rather than having a dedicated cables from ODU 108 for each IRD 112A-D, e.g., one cable per IRD 108, system 130 uses a single cable 132 from ODU 108 to a splitter 134, and then directs individual cables 136-142 from splitter 134 to various types of IRDs 112A-D. Splitter 134 is typically located within the home, so only one cable 132 needs to enter the home to provide the signals from SWM ODU 108 for all IRDs 112A-D present in a given residence. For example, in one embodiment, IRD 112A can be a single tuner Standard Definition (SD) IRD, while IRD 112B can be a two-tuner SD Digital Video Recorder (DVR). Further, both SD and High Definition (HD) signals can be sent in system 130, such that both SD and HD signals can be sent through splitter 134 to various IRDs 112A-D. In the same embodiment as described above, IRD 112C can be a single tuner HD IRD, and IRD 112D can be a two-tuner HD DVR. Other combinations of IRDs 112A-D, with SD, HD, or combinations of SD and HD signals, can be accommodated by system 130.

System 130 allows for reduced installation complexity and lowers cost. Downlink signals 120 from satellites 102-106 are received at the SWM ODU 108 in the same manner as described with respect to FIG. 2. However, system 130 typically uses Frequency Shift Keyed (FSK) commands with a signal splitter 134 to allow for two-way communications between the ODU 108 and the various IRDs 112A-D. Other types of command structures can be used in different embodiments of system 130 if desired. The system 130 allocates a transponder channel for each connected IRD 112A-D. There are typically eight distinct programming channels available for use by the various IRDs 112A-D, however, a larger or smaller number of channels can be made available if desired. The SWM system 130 allocates one channel to single tuner IRDs 112A-D and two channels for two-channel (DVR)-based IRDs 112A-D. Each IRD 112A-D sends messages to the SWM ODU 108 requesting a desired transponder for viewing, and the SWM ODU 108 circuit receives similar requests from all connected and active IRDs 112A-D. The SWM ODU 108 then selects or "plucks" the receiver requested transponder from the received downlink signals 120, locates the selected transponder signal in the allocated channel for the requesting IRD 112-A-D, and aggregates all of the selected transponder channels for active IRDs 112A-D for transmission using single cable 132.

It can be seen, then, that there is a need in the art for an alignment method for a satellite broadcast system that can be expanded to include new satellites and new transmission frequencies.

SUMMARY OF THE INVENTION

To minimize the limitations in the prior art, and to minimize other limitations that will become apparent upon reading and understanding the present specification, the present invention discloses a method and system for aligning a multi-satellite receiver antenna with satellites in a satellite configuration. A method in accordance with one or more embodiments of the present invention comprises pointing the reflector to a position along an orbital arc used in the satellite configuration, commanding a Single Wire Multiswitch (SWM) which is coupled to the reflector of the antenna to output a signal from at least one satellite at the orbital slot, and adjusting the reflector to maximize reception of the signal from the orbital slot.

Such a method may further optionally comprise the SWM being commanded to output a single transponder from the satellite at the orbital slot using Frequency Shift Keyed (FSK) commands, the reception being maximized by reading a meter which measures a received power of the signal from the orbital slot, commanding the SWM to output a second signal from a second orbital slot and adjusting the reflector to maximize reception of the second signal from the second orbital slot, and the satellite in the orbital slot transmits in a Ku-band and/or Ka-band of frequencies.

A system in accordance with one or more embodiments of the present invention comprises a reflector, a SWM coupled to the reflector, a power meter coupled to the SWM, wherein the power meter and reflector are tuned to receive a signal from a satellite in the satellite configuration, an alignment mechanism, coupled to the reflector, wherein the alignment mechanism is manipulated to point the reflector at a point along an orbital arc, and a controller, coupled to the power meter and commanding the SWM, to output signals from at least one satellite at a first orbital slot, wherein the reflector is aligned by maximizing a signal strength of the signal being measured on the power meter.

Such a system may further optionally include the SWM being commanded to output a single transponder from the satellite in the satellite configuration, the SWM being commanded using frequency shift keyed commands, the power meter being an analog power meter, or a digital power meter that demodulates at least one transponder signal and reports a carrier-to-noise ratio of the demodulated transponder signal, the controller further commanding the SWM to output a second signal from a second orbital slot and the reflector is aligned by maximizing a signal strength of the second signal from the second orbital slot, and the satellite in the orbital slot transmits in a Ku-band and/or Ka-band of frequencies.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

Figure 1:
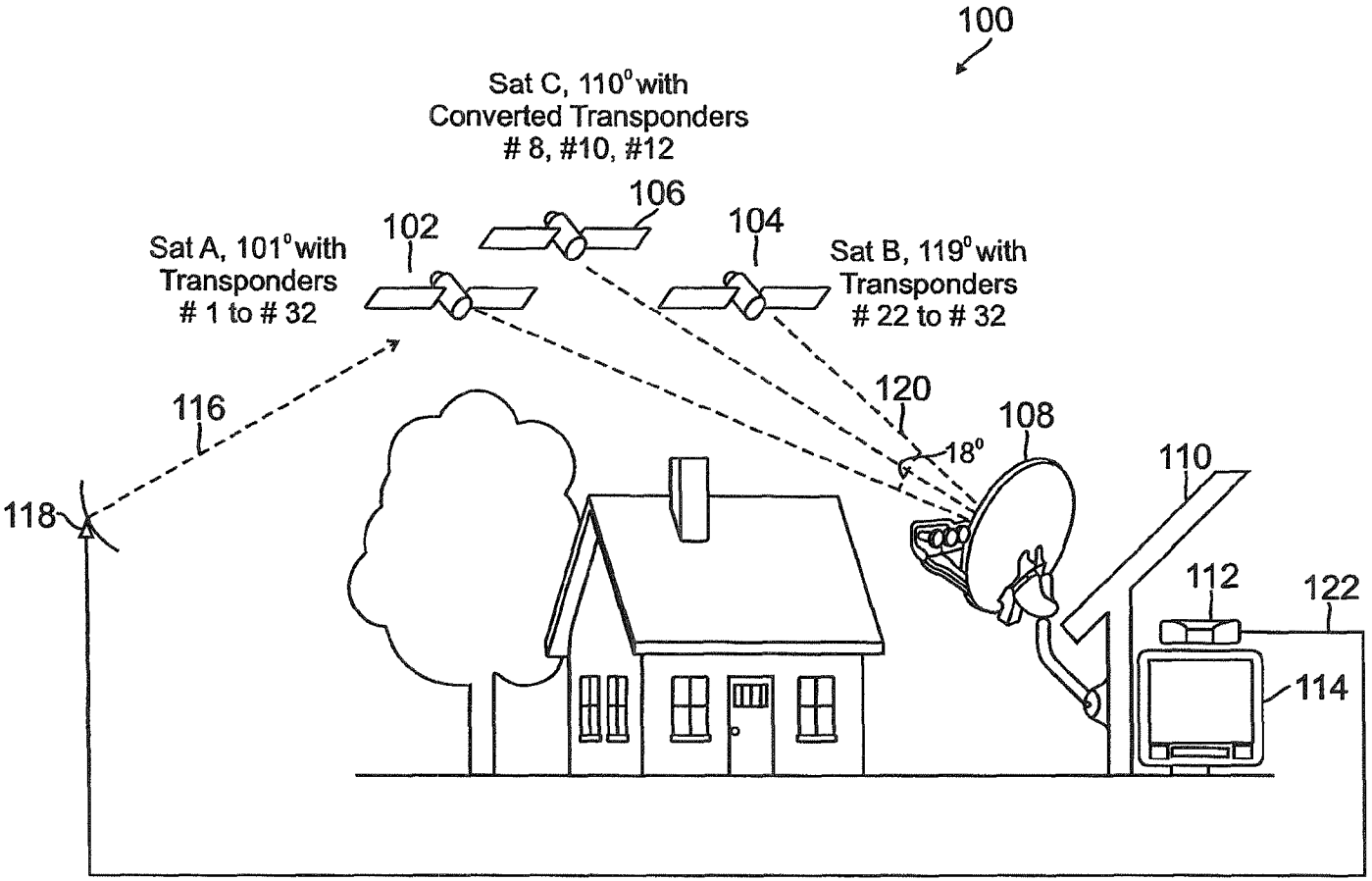
FIG. 1 Prior Art
FIG. 1 illustrates a typical satellite television installation of the related art.

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

System 100 uses signals sent from Satellite A (SatA) 102, Satellite B (SatB) 104, and Satellite C (SatC) 106 that are directly broadcast to an Outdoor Unit (ODU) 108 that is typically attached to the outside of a house 110. Additionally, system 100 uses signals sent from satellites 102-106, as well as other satellites, which can be broadcast at a different frequency band than the signals sent by satellites 102-106 for use in system 100.

Satellites 102, 104, and 106 broadcasts downlink signals 120 in typically thirty-two (32) different frequencies for Ku-band, and other assignments for the Ka-band downlink signals 120, which are licensed to various users for broadcasting of programming, which can be audio, video, or data signals, or any combination. These signals are typically located in the Ku-band of frequencies, i.e., 11-18 GHz. Other satellites typically broadcast in the Ka-band of frequencies, i.e., 18-40 GHz, but typically 20-30 GHz with 16 transponder assignments within a 500 MHz band. Satellites 102-106 can broadcast in multiple frequency bands if desired.

The orbital locations of satellites 102-106 are fixed by regulation, so, for example, there are one or more satellites at 101 degrees West Longitude (WL), represented by SatA 102; other satellites at 110 degrees WL, represented by SatC 106; and still other satellites at 119 degrees WL, represented by SatB 104. Other groups of satellites are located at other orbital slots, such as 102.8 degrees WL, and still other satellites are located at the orbital slot at 99.2 degrees WL. Other satellites may be at other orbital slots, e.g., 72.5 degrees, 95 degrees, and other orbital slots, without departing from the scope of the present invention. The satellites are typically referred to by their orbital location, e.g., SatA 102, the satellite at 101 WL, is typically referred to as "101."

Dish Alignment

Requirements for consumer receiver dish (ODU 108) alignment are less stringent than with a larger fleet of satellites or when the receiving beam width of the ODU is reduced, as could be the case for Ka-band operations. The more rigorous alignment specs are in large part due to the relatively new art of broadcasting Direct-To-Home (DTH) signals in the Ka-band of frequencies.

Ka-band ODU receiving antenna beams are more narrow than the traditional Ku-band beams. As such, the ODU 108 must be pointed to the transmitting satellite(s) more accurately. If the ODU 108 alignment is not accurate enough, a sharp roll-off in signal strength will result, which may not allow IRD 112 to properly decode the transmitted signals.

Another fact that necessitates accurate alignment of the ODU 108 in the FSS Ka-frequency band is that Ka-band satellites are separated by only 2 degrees (nominally) along the orbital arc, as opposed to the relatively large satellite spacing of 9 degrees used for the satellites transmitting in the BSS Ku-band of frequencies. If the ODU 108 is not accurately pointed to the Ka-band source, then it can be subject to co-frequency interference from adjacent Ka-band satellites.

The present invention uses satellites placed at a particular locations in orbit, and those satellites' position relative to the center of a plurality of orbital slots, in order to make possible very accurate pointing of a consumer receive antenna (ODU).

Description of Orbital Slot Alignment

Figure 3:
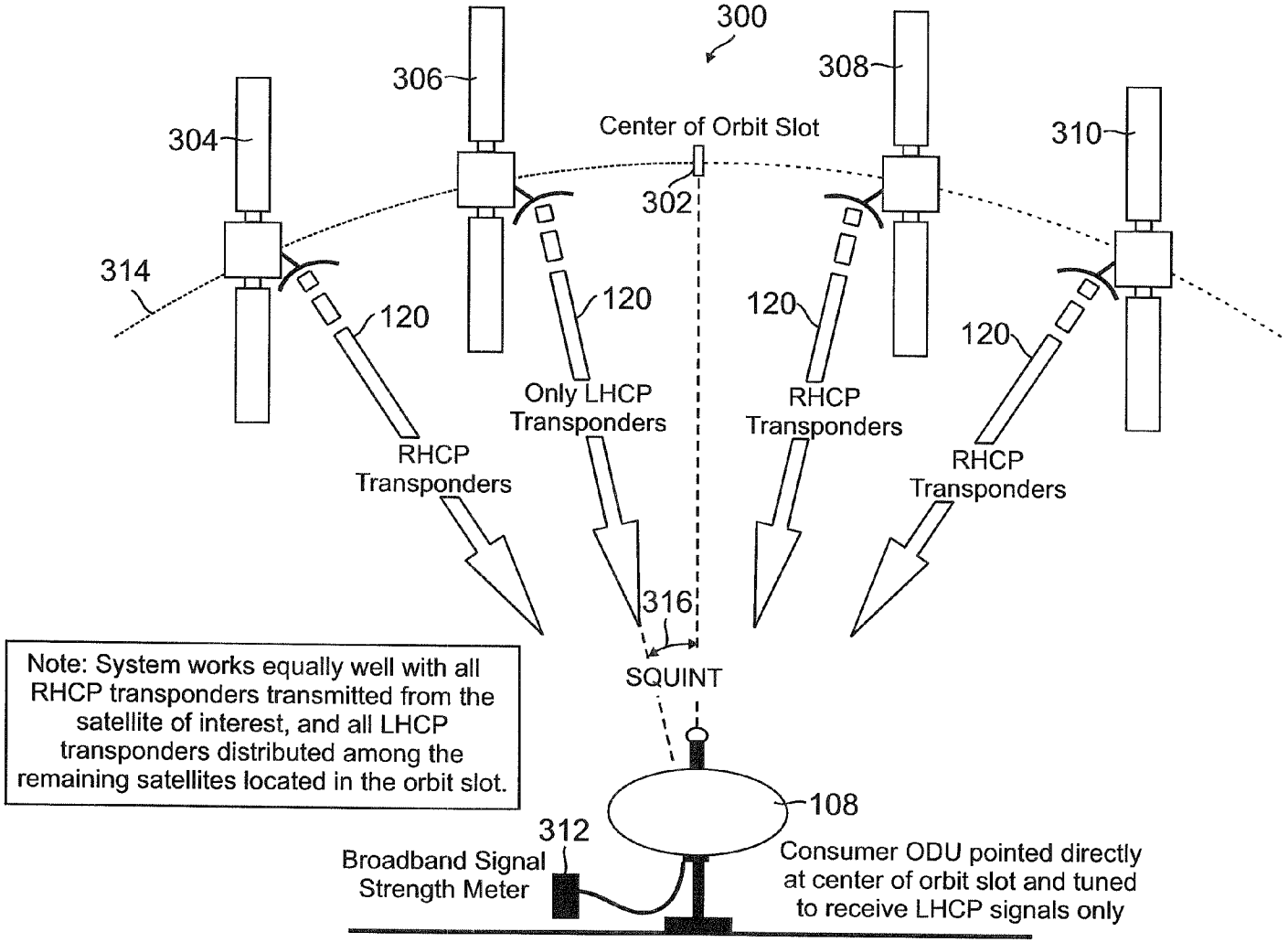
FIG. 3 illustrates a typical orbital slot as used in conjunction with one or more embodiments of the present invention.

FIG. 3 illustrates a typical orbital slot as used in conjunction with one or more embodiments of the present invention.

Orbital slot 300 is shown, comprising satellites 304-310. Orbital slot 300 can be any orbital slot, e.g., 99, 101, 75, 119, 103, etc., without departing from the scope of the present invention.

As shown in FIG. 3, the ODU 108, to be properly aligned to all of the satellites 304-310 in the orbital slot 300, should point to the alignment point 302 of the orbital slot 300, which aligns the boresight of ODU 108 to orbital slot 300. However, if a given orbital slot 300 has two satellites, say 304 and 306, on one side of the alignment point 302, and only one satellite 308 on the other side of the alignment point 302, another alignment point 302 can be chosen for ODU 108. Such an alignment point 302 can be chosen through the use of offsets from a maximum signal strength, design of the ODU 108, or other methods.

Typically, the ODU 108 is aligned using a power meter 312 that measures the power for a broad signal spectrum for signals originating from a particular orbital slot at a particular polarization. As such, ODU 108 is aligned to a point in azimuth and elevation that maximizes the average power for the orbital slot selected. Repeating this process for signals originating from another orbital slot should provide optimal pointing of the ODU in the tilt direction.

The problem with using power meter 312 is that a power meter measures the broad power from all of the transponders located at satellites 304-310, which may or may not result in having ODU 108 point to the center of the orbit slot along arc 314. The present invention uses signals of a specific polarization, e.g., Left-Hand Circularly Polarized (LHCP) signals, transmitted from only one of the satellites, e.g., satellite 306, and the phenomenon of beam squint 316, to properly align the ODU 108 directly to the center of the orbit slot along the orbital arc 314.

Since the locations of each of the satellites 304-310 is precisely known, the present invention utilizes that knowledge, and programs the electronics connected to the ODU 108 (also referred to as the Frequency Translation Module (FTM) or Single Wire Multiswitch (SWM) or, when coupled to ODU 108, the Integrated-ODU (I-ODU) or (SWM-ODU) to command the Low-Noise Block Amplifier (LNB) to output signals of a given polarization, which is known to be transmitted only from a given satellite, e.g, LHCP from satellite 306. This, coupled with the known beam squint 316 of satellite 306 for the LHCP transponders, will boresight the ODU 108 directly at the center of the orbit slot along arc 314. So by only accepting power input from a single satellite through the use of polarization "filtering", the alignment procedure of the present invention is achieved to point the ODU directly at the center of the orbital slot, rather than the spot where the average power peak is located.

Figure 2:
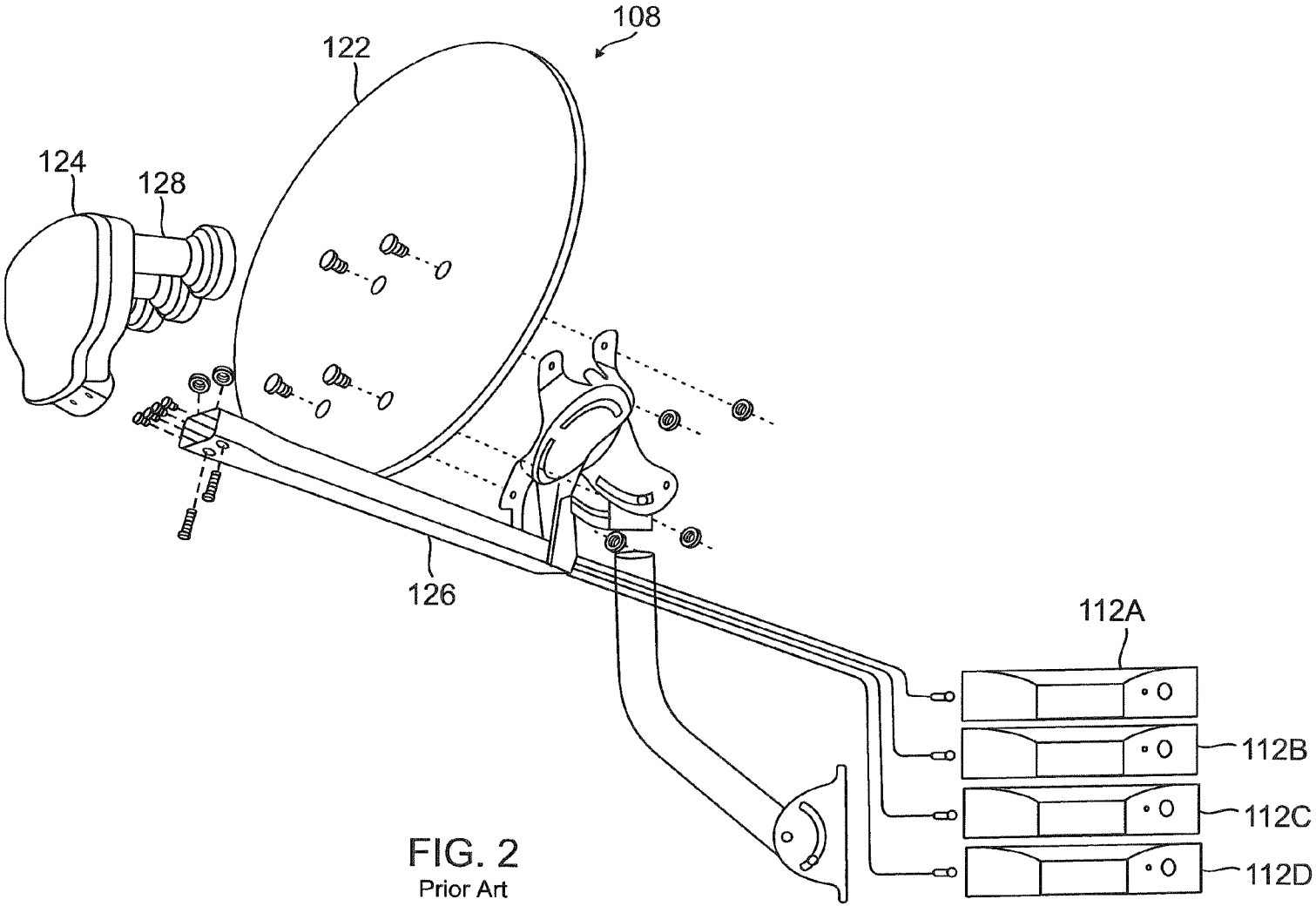
FIG. 2 Prior Art
FIG. 2 illustrates a typical ODU of the related art.
Figure 2A:
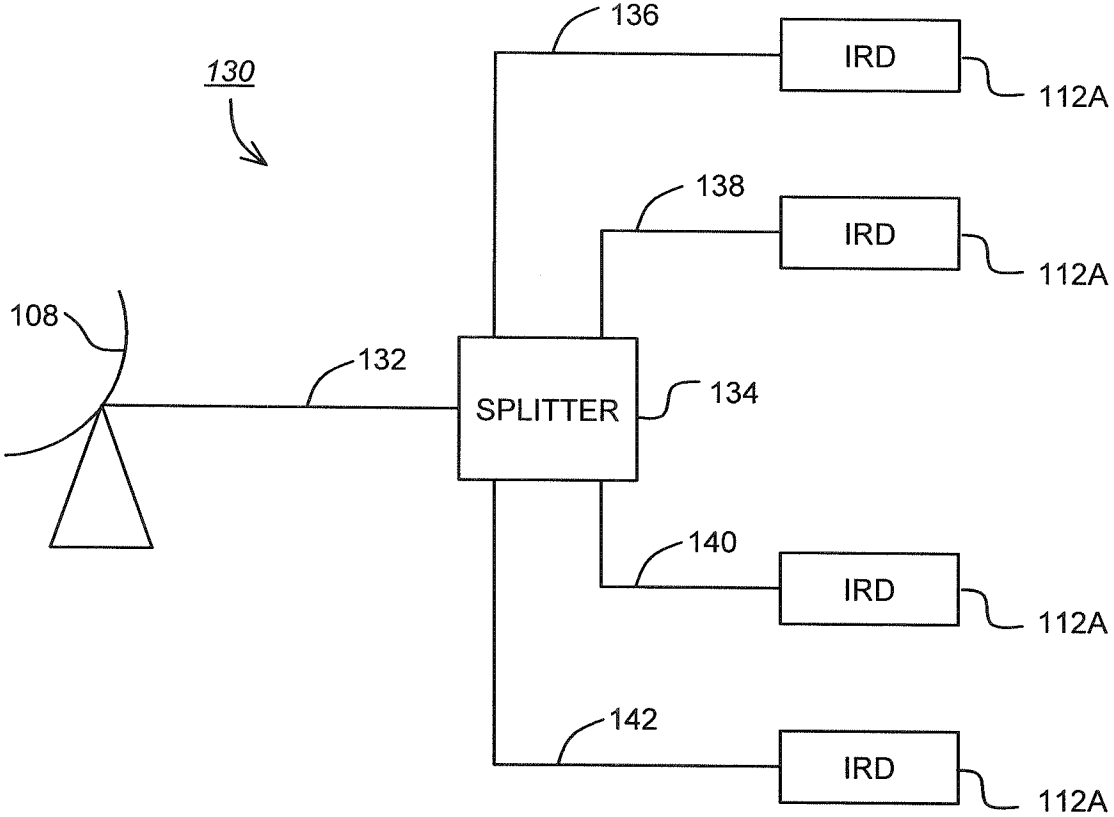
FIG. 2A Prior Art
FIG. 2A illustrates an ODU of the related art.

In the case of a SWM ODU 108 described in FIG. 2A, the SWM electronics accepts all the transponders the SWM ODU 108 receives, and the commands issued by a controller in the SWM ODU 108 changes the specific transponders output on each of the SWM ODU 108 output frequencies.

To facilitate SWM ODU 108 alignment, when power is applied to the SWM ODU 108 without connecting IRDs 112A-D, a circuit in power meter 312 activates an ODU alignment mode in the SWM ODU 108. In this particular embodiment, the SWM ODU 108 circuitry can place a number, typically four, default selected transponders from satellite(s) located at various orbital slots, typically the 101 orbital slot in four channels and another four transponders from the 119 WL orbital slot, but other orbital slots and satellites can be used without departing from the scope of the present invention. This facilitates the alignment of SWM ODU 108 in a similar manner to other embodiments of the ODU 108.

Beam squint occurs when a circularly polarized feed (the transmitter) illuminates any offset-feed reflector system. Beam squint is a bias, in terms of degrees, of the peak power from a true boresight of the transmitter's reflector. It is, in essence, a shifting of the power density output of the transmitter from directly on boresight to slightly off-boresight, where the shift is based on the offset of the feed horn from the center of the reflector.

Here, beam squint 316 is designed on satellite 306 such that the physics of the beam squint 316 is identical to the bias of satellite 306 from the center of the orbital slot. As such, the combination of this beam squint 316 (offset of the power density transmitted from satellite 306) and the peak power from only satellite 306 as measured by power meter 312 combine to align ODU to the center of the orbit slot 302, rather than directly to satellite 306. If satellite 306 moves along arc 314, that knowledge can be used to align the ODU as well, since now the combination of the beam squint 316 will not be exactly the same as the difference between satellite 306 and center 302, so an offset, in terms of degrees, can be applied to the alignment procedure of the present invention.

This can be accomplished using the present invention in several ways. For example, the present invention can command the electronics coupled to ODU 108 to output specific transponders from satellite 306 that transmit LHCP signals (e.g., for "Slimline ODU" 108 installations), where the broadband power meter 312 now measures several signals 120 from several transponders on satellite 306 that transmit in LHCP. Thus, power meter 312 is measuring the broad spectrum of LHCP signals that are transmitted from satellite 306, and that broad power, combined with the beam squint 316 offset, aligns ODU 108 to center 302.

However, the present invention can also program the FTM/I-ODU (SWM-ODU) 108 to output signals from only one transponder or one group of transponders from one satellite, e.g., satellite 306, at a single polarization, and only passes these signals to the power meter 316. Rather than receiving several signals, a specific signal, which may carry with it additional knowledge, e.g., the beam squint 316 for that signal or group of signals is more precisely known than the beam squint 316 for all LHCP signals from satellite 306, and, as above, the alignment of ODU 108 is performed.

System Implementation

Figure 4:
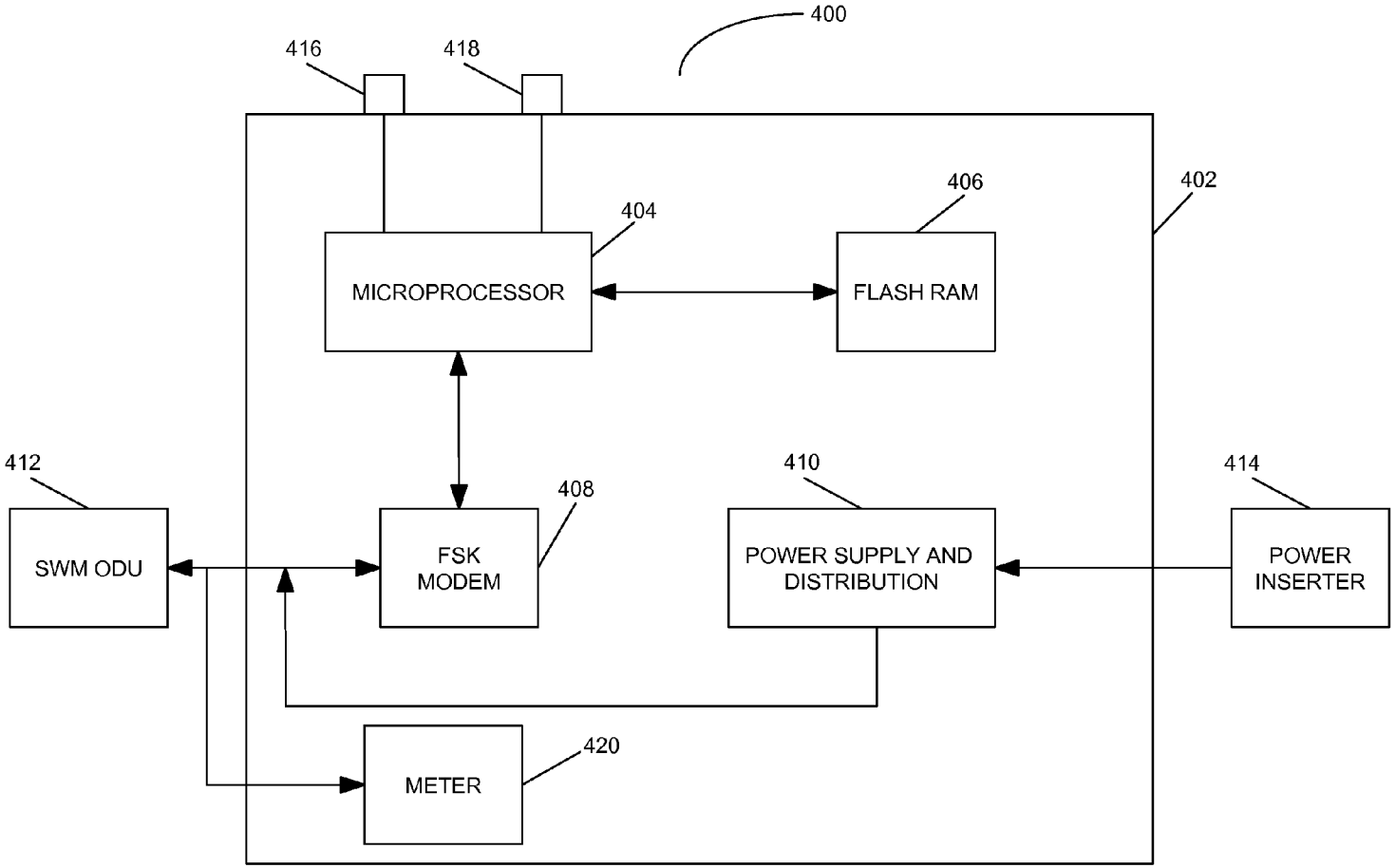
FIG. 4 illustrates a system in accordance with one or more embodiments of the present invention.

FIG. 4 illustrates a system in accordance with one or more embodiments of the present invention.

System 400 illustrates controller 402, which comprises microprocessor 404, memory (Flash RAM) 406, FSK modem 408, and power supply 410. The Single Wire Multiswitch ODU (SWM ODU) Controller 402 is designed to assist with pointing and aligning the SWM ODU 412 toward the correct satellite slots. The SWM ODU 412 combines a Slimline Ka/Ku LNB and horn antennas for 99/101/101/110/119 slots with a SWM circuits all integrated into one housing.

The main parts of the controller 402 are the FSK modem 408, a microprocessor 404 with flash memory 406 to store the commands, an input Type-F connector which couples to SWM ODU 412 and an output Type-F connector which couples controller 402 to a power inserter 414. The microprocessor 404 is used to generate the commands per the programming firmware stored in the flash memory 406 and the state of the two pushbutton switches. The flash memory is typically configured to be easily reprogrammed and/or replaced. DC power for the controller and I-ODU is provided by a power inserter 414 connected to the controller's output Type-F connector. Commands are issued using simple controls such as two pushbutton switches 416 and 418. Switch #1 416 commands the controller 402 to send commands to the SWM ODU 412 to output all RHCP transponders at the 101 slot and switch #2 418 would command the controller 402 to send commands to the SWM ODU 412 to output all 119 transponders to allow for the skew adjustment using these transponders. Additional switches and command scenarios are also possible with the present invention.

The SWM in the SWM ODU 412 is commanded using a Frequency Shift Keying (FSK) modem (usually located in IRD 112) with a proprietary command list and syntax, although other types of communications commands can be used without departing from the scope of the present invention. Since the SWM outputs a selected satellite transponder on each of the SWM output frequencies (SWM channels), up to a typical maximum of nine (although the number of FTM outputs can be any number) depending on the specific SWM design, when installing an SWM ODU 412 a device is needed to select which transponders are output on each frequency during the ODU pointing and alignment process. The SWM ODU controller 402 provides properly syntaxed FSK commands via FSK modem 408 to drive the SWM ODU 412 outputs and properly align the antenna dish of the SWM ODU 412.

The SWM ODU controller 402 controls the new SWM ODU 412 in order to enable pointing the subscriber antenna dish 122 at the correct location in the orbital arc 314. For example, the current process involves first maximizing the signal for a Right-Hand Circularly Polarized (RHCP) transponder transmitted from the 101 slot as described with respect to FIG. 3. The next step is to fine adjust the tilt of the reflector antenna by maximizing the signal from a transponder located at the 119 slot, also as described in FIG. 3.

Two different types of meters can be used to perform the alignment process for SWM ODUs 412. One possibility is an analog meter, which measures the total integrated power in the 950-1450 MHz band. Use of an analog meter would require that the controller 402, via the microprocessor 404 control of FSK modem 408, assign a plurality of output SWM channels, typically at least 4 of the SWM channels in the SWM ODU 412 to the band of interest (101 RHCP, 119 RH/119LH). The meter will then be able to read the average power that is being received from the selected transponders and provide feedback to the installer to maximize the received power. A greater or smaller number than 4 outputs can be used without departing from the scope of the present invention.

The second possibility is to use a portable digital meter that demodulates the selected transponder and reports the carrier-to-noise ratio (CNR). In this case, only one of the nine SWM channel frequencies need be assigned to the band of interest, but the controller 402 will need to be programmed to demodulate that frequency, again, via microprocessor 404 control of FSK modem 408. Reflector antenna alignment is accomplished by maximizing the integrated RF power, or the carrier-to-noise ratio, using the analog or digital meters respectively, first for one slot (e.g., 101) and then the other (e.g., 119). No measurements are made using transponders from the 99, 103, or 110 slots, but can be made through additional commanding of FSK modem 408.

As such, several sets of instructions, e.g., FSK commands with proper syntax, can be stored in memory 406, and selected by the user of controller 402 depending on the desires and/or needs of the particular installation. For example, and not by way of limitation, one installation may just check the satellites that are on the ends of the orbital arc 314, while other installations may wish to maximize the received power from specific satellites within the orbital arc 314, e.g., those satellites that transmit in the Ka-band of frequencies (typically satellites at the 99 and 101 orbital slots). By storing different sets of commands in memory 406, microprocessor 404 can be used to command FSK modem 408 to provide proper inputs to SWM ODU 412 to perform several different types of installations without undue training and/or supervision of installers of SWM ODUs 412.

Alignment Procedure

The alignment procedure envisioned in the present invention for use with the SWM ODU is as follows. For example, and not by way of limitation, the SWM ODU 412 could first be commanded by microprocessor 404 via FSK modem 408 to provide a single 101 RHCP transponder on each of the SWM output frequencies, or alternatively the controller could assign a different 101 RHCP transponder to each of the SWM output frequencies.

The output of the SWM ODU 412 is then measured by meter 420, which can be a digital or analog meter. The automatic gain control in the SWM is subsequently commanded to turn OFF by the microprocessor 404 via FSK modem 408, so that the output signal will then be roughly proportional to the input signal power. The signal peaking is then performed using the analog or digital meter 420 while an installer moves the reflector 122 to maximize the reading on meter 420.

The second step is to command the SWM circuits in the SWM ODU 412 to output only transponders originating from the 119 slot, again via the microprocessor 404 and FSK modem 408, and a similar signal peaking is performed by rotating the dish with respect to the aligned 101 slot to maximize the reading on meter 420. This approach requires only two states for the controller 402, other options could also be provided if desired. Meter 420 can be separate from controller 402 if desired.

Process Chart

Figure 5:
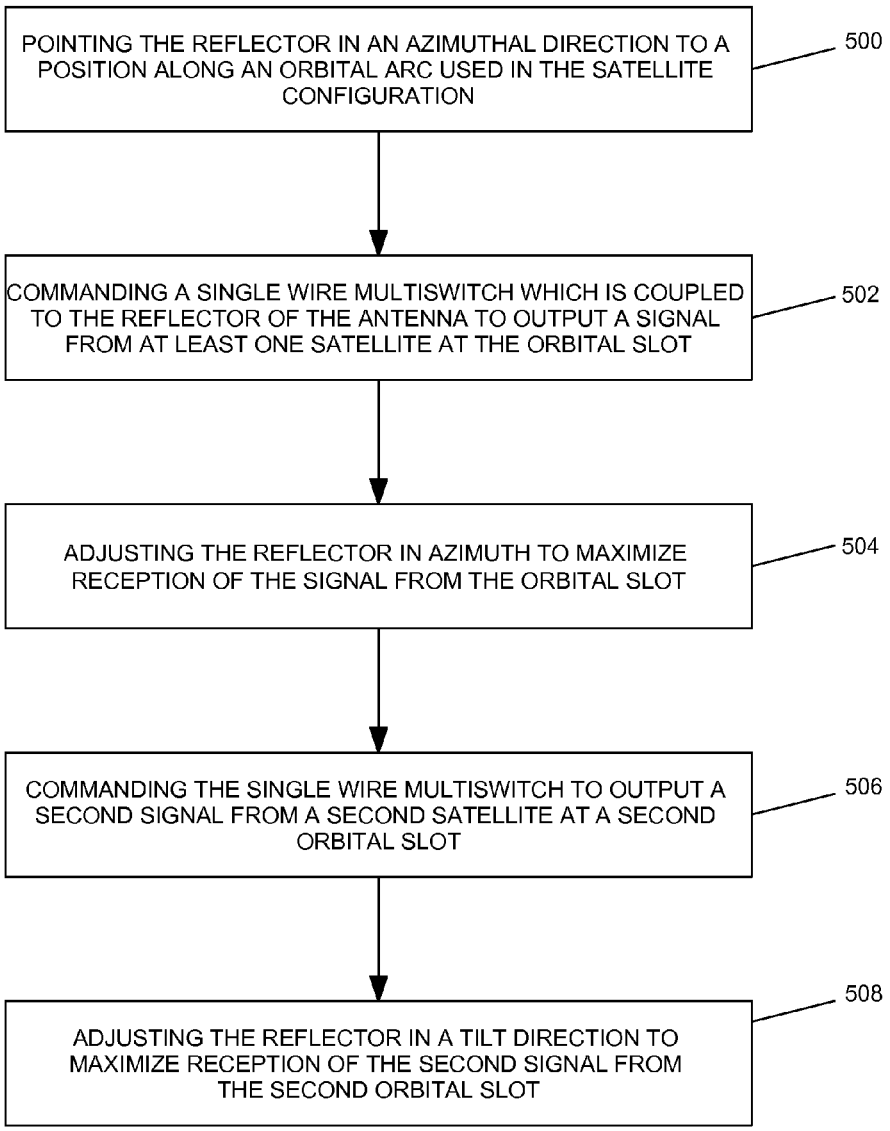
FIG. 5 illustrates a process chart in accordance with one or more embodiments of the present invention.

FIG. 5 illustrates a process chart in accordance with one or more embodiments of the present invention.

Box 500 illustrates pointing the reflector in an azimuthal direction to a position along an orbital arc used in the satellite configuration.

Box 502 illustrates commanding a Single Wire Multiswitch circuit which is coupled to the reflector of the antenna to output a signal from at least one satellite at the orbital slot. Box 504 illustrates adjusting the reflector in azimuth to maximize reception of the signal from the orbital slot.

Box 506 illustrates commanding the Single Wire Multiswitch circuits to output a second signal from a second satellite at a second orbital slot.

Box 508 illustrates adjusting the reflector in a tilt direction to maximize reception of the second signal from the second orbital slot.

CONCLUSION

In summary, the present invention comprises a method and system for aligning an antenna reflector with satellites in a satellite configuration.

A method in accordance with one or more embodiments of the present invention comprises pointing the reflector to a position along an orbital arc used in the satellite configuration, commanding a Single Wire Multiswitch (SWM) which is coupled to the reflector of the antenna to output a signal from at least one satellite at the orbital slot, and adjusting the reflector to maximize reception of the signal from the orbital slot.

Such a method may further optionally comprise the SWM being commanded to output a single transponder from the satellite at the orbital slot using frequency shift keyed commands, the reception being maximized by reading a meter which measures a received power of the signal from the orbital slot, commanding the SWM to output a second signal from a second orbital slot and adjusting the reflector to maximize reception of the second signal from the second orbital slot, and the satellite in the orbital slot transmits in a Ku-band and/or Ka-band of frequencies.

A system in accordance with one or more embodiments of the present invention comprises a reflector, a SWM, coupled to the reflector, a power meter coupled to the SWM, wherein the power meter and reflector are tuned to receive a signal from a satellite in the satellite configuration, an alignment mechanism, coupled to the reflector, wherein the alignment mechanism is manipulated to point the reflector at a point along an orbital arc, and a controller, coupled to the power meter and the SWM, for commanding to output signals from at least one satellite at a first orbital slot, wherein the reflector is aligned by maximizing a signal strength of the signal being measured on the power meter.

Such a system may further optionally include the SWM being commanded to output a single transponder from the satellite in the satellite configuration frequency shift keyed commands, the power meter being an analog power meter, or a digital power meter that demodulates at least one transponder signal and reports a carrier-to-noise ratio of the demodulated transponder signal, the controller further commanding the SWM to output a second signal from a second orbital slot and the reflector is aligned by maximizing a signal strength of the second signal from the second orbital slot, and the satellite in the orbital slot transmits in a Ku-band and/or Ka-band of frequencies.

It is intended that the scope of the invention be limited not by this detailed description, but rather by the claims appended hereto and the full range of equivalents thereof. The above specification, examples and data provide a description of the manufacture and use of the composition of the invention.

Since many embodiments of the invention can be made without departing from the spirit and scope of the invention, the invention resides in the claims hereinafter appended and the full range of the equivalents of the claims.

What is claimed is:

1. A method for aligning a reflector of an antenna with a satellite configuration, comprising:

pointing the reflector in an azimuthal direction to a position along an orbital arc used in the satellite configuration;

commanding a single wire multiswitch (SWM) which is coupled to the reflector of the antenna to output a signal from at least one satellite at the orbital slot, the signal being selected based on a beam squint of the signal;

adjusting the reflector in azimuth to maximize reception of the signal from the orbital slot;

commanding the SWM to output a second signal from a second satellite at a second orbital slot; and adjusting the reflector in a tilt direction to maximize reception of the second signal from the second orbital slot.

2. The method of claim 1, wherein the SWM is commanded to output a single transponder from the satellite at the orbital slot.

3. The method of claim 1, wherein the SWM is commanded using frequency shift keyed commands.

4. The method of claim 1, wherein the reception is maximized by reading a meter which measures a received power of the signal from the orbital slot.

5. The method of claim 1, wherein the SWM is commanded to output a specific group of transponders from the satellite at the orbital slot.

6. The method of claim 1, wherein the satellite in the orbital slot transmits in a Ka-band of frequencies.

7. A system for aligning a reflector of an antenna with a satellite configuration, comprising:

a reflector;

a single wire multiswitch (SWM), coupled to the reflector;

a power meter coupled to the reflector, wherein the power meter and reflector are tuned to receive a signal from a satellite in the satellite configuration, the signal being selected based on a beam squint of the signal;

an alignment mechanism, coupled to the reflector, wherein the alignment mechanism is manipulated to point the reflector at a point along an orbital arc; and a controller, coupled to the power meter and the SWM, for commanding to output signals from at least one satellite at a first orbital slot, wherein the reflector is aligned by maximizing a signal strength of the signal being measured on the power meter.

8. The system of claim 7, wherein the SWM is commanded to output a single transponder from the satellite in the satellite configuration.

9. The system of claim 7, wherein the SWM is commanded using frequency shift keyed commands.

10. The system of claim 7, wherein the power meter is an analog power meter.

11. The system of claim 7, wherein the power meter is a digital power meter wherein the power meter demodulates at least one transponder signal and reports a carrier-to-noise ratio of the demodulated transponder signal.

12. The system of claim 7, wherein the controller further commands the SWM to output a second signal from a second orbital slot; and the reflector is aligned by maximizing a signal strength of the second signal from the second orbital slot.

13. The system of claim 7, wherein the satellite in the orbital slot transmits in a Ka-band of frequencies.

14. The system of claim 7, wherein the satellite in the orbital slot transmits in a Ku-band of frequencies.

* * * * *